US008932443B2

(12) United States Patent
Sto. Domingo

(10) Patent No.: US 8,932,443 B2
(45) **Date of Patent: *Jan. 13, 2015**

(54) ADJUSTABLE WAFER PLATING SHIELD AND METHOD

(71) Applicant: DECA Technologies Inc., Tempe, AZ (US)

(72) Inventor: Rico Sto. Domingo, Calamba (PH)

(73) Assignee: DECA Technologies Inc., Tempe, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/895,987

(22) Filed: May 16, 2013

(65) Prior Publication Data

US 2013/0248361 A1 Sep. 26, 2013

Related U.S. Application Data

(63) Continuation-in-part of application No. 13/250,070, filed on Sep. 30, 2011, now Pat. No. 8,784,621, and a continuation-in-part of application No. 13/631,204, filed on Sep. 28, 2012.

(Continued)

(51) Int. Cl.
*B23H 7/26* (2006.01)
*H05K 3/00* (2006.01)
(Continued)

(52) U.S. Cl.
CPC ..... *C25D 17/06* (2013.01); *C25D 21/00* (2013.01); *C25D 17/008* (2013.01); *C25D 17/001* (2013.01)
USPC ..... 204/297.05; 204/297.01; 29/829

(58) Field of Classification Search
CPC .... C25D 17/06; C25B 9/02; H01L 21/67359; H01L 21/67353; H01L 21/6735
USPC ..... 204/297.01, 297.05; 29/829
See application file for complete search history.

(56) References Cited

U.S. PATENT DOCUMENTS 5,316,642 A 5/1994 Young, Jr. et al.
6,365,020 B1 4/2002 Yoshioka et al.
(Continued)

FOREIGN PATENT DOCUMENTS

TW I241699 B 10/2005

OTHER PUBLICATIONS

Herrault, F., Fabrication and Performance of Silicon-Embedded Permanent-Magnet Microgenerators, Journal of Microelectromechanical Systems, vol. 19, Issue 1, pp. 3-13, Feb. 200.
(Continued)

*Primary Examiner* — Luan Van
*Assistant Examiner* — Alexander W Keeling
(74) *Attorney, Agent, or Firm* — Booth Udall Fuller, PLC

(57) ABSTRACT

A wafer carrier is described. In one embodiment, the wafer carrier includes a variable aperture shield. The wafer carrier may include an electrically conductive wafer plating jig base having a plurality of concentric overlapping cavities of different depths, each cavity configured to receive a semiconductor wafer of a different size, a plurality of concentric magnetic attractors, at least one positioned within each of the plurality of overlapping cavities, and a cover plate comprising an open center surrounded by a support, the cover plate comprising an attractive material positioned within the support adjacent to the open center and aligned with at least one of the magnetic attractors when the cover plate is positioned over the wafer plating jig base.

28 Claims, 13 Drawing Sheets

Related U.S. Application Data

(60) Provisional application No. 61/494,339, filed on Jun. 7, 2011, provisional application No. 61/540,238, filed on Sep. 28, 2011, provisional application No. 61/673,115, filed on Jul. 18, 2012.

(51) Int. Cl.

| | |
|---|---|
| ***C25D 17/06*** | (2006.01) |
| ***C25D 21/00*** | (2006.01) |
| ***C25D 17/00*** | (2006.01) |

(56) References Cited

U.S. PATENT DOCUMENTS

| | | | | |
|---|---|---|---|---|
| 6,395,581 | B1 | 5/2002 | Choi | |
| 6,402,923 | B1 * | 6/2002 | Mayer et al. | 205/96 |
| 6,514,393 | B1 * | 2/2003 | Contolini et al. | 204/297.03 |
| 7,445,697 | B2 | 11/2008 | Keigler et al. | |
| 7,622,024 | B1 | 11/2009 | Mayer et al. | |
| 7,712,211 | B2 | 5/2010 | Chia et al. | |
| 7,830,011 | B2 | 11/2010 | Nomoto et al. | |
| 8,106,488 | B2 | 1/2012 | Chua et al. | |
| 2009/0093085 | A1 | 4/2009 | Onodera et al. | |
| 2012/0024230 | A1 | 2/2012 | Li et al. | |

OTHER PUBLICATIONS

Golda, D. et al., Two-Layer Electroplated Microcoils With a PECVD Silicon Dioxide Interlayer Dielectric, Journal of Microelectromechanical Systems, vol. 17, Issue 6, pp. 1537-1545, Dec. 2008.

* cited by examiner 212
213
210
211
212

214
215
217
215
212
212
214
214a 210
214
211
216
215
214b
201
200

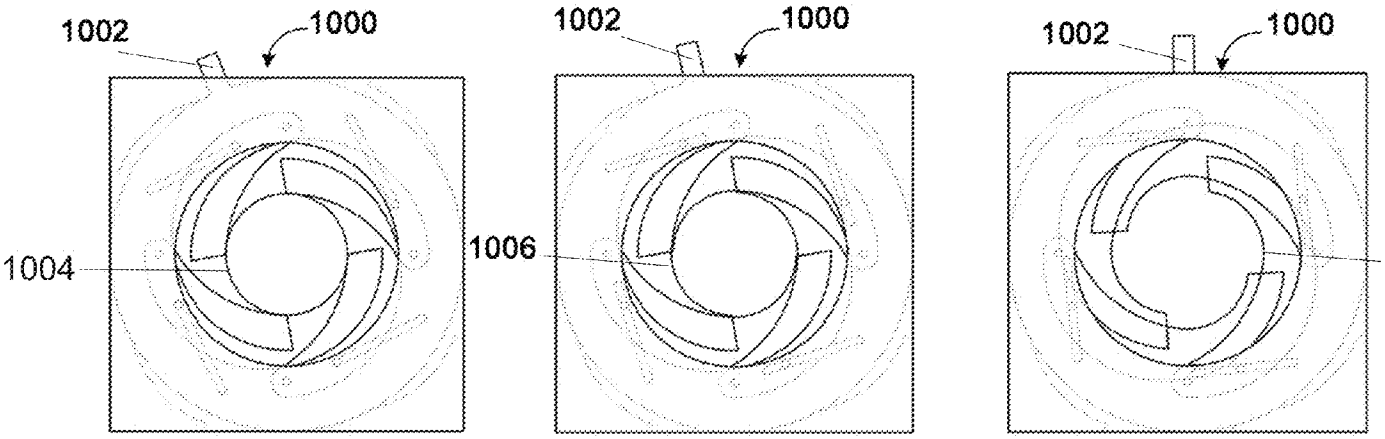
FIG. 10A
FIG. 10B
FIG. 10C
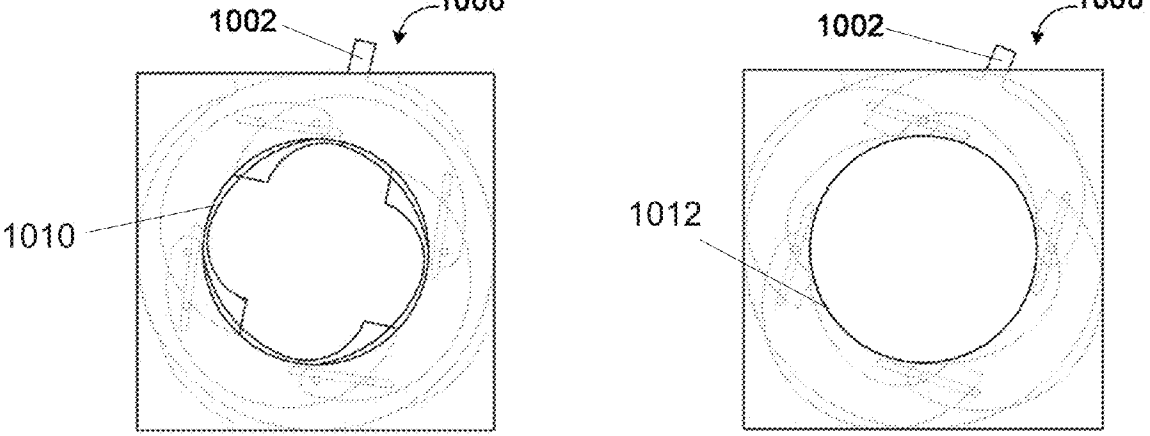
FIG. 10D
FIG. 10E

ADJUSTABLE WAFER PLATING SHIELD AND METHOD

RELATED APPLICATIONS

This application is a continuation-in-part of U.S. application Ser. No. 13/250,070, filed Sep. 30, 2011, which claims the benefit of U.S. Provisional Application No. 61/494,339 filed Jun. 7, 2011, and claims the benefit of U.S. Provisional Application No. 61/540,238 filed Sep. 28, 2011. This application is also a continuation-in-part of U.S. application Ser. No. 13/631,204, filed Sep. 28, 2012, which claims the benefit of U.S. Provisional Application No. 61/673,115, filed Jul. 18, 2012, the disclosures of which are hereby incorporated herein by reference.

TECHNICAL FIELD

This disclosure relates to the field of semiconductor device manufacturing and, in particular, to an adjustable wafer plating shield for wafer plating.

BACKGROUND

Integrated circuits are formed through a process known as semiconductor device fabrication. The semiconductor device may be formed on a thin slice, or wafer, of semiconductor material, such as silicon crystal. The wafer serves as a substrate for microelectronic devices built on the wafer. During fabrication of these integrated circuits, the silicon wafer is put through a sequence of wet chemical processing steps. One wet chemical processing step in the sequence is electrochemical deposition, commonly known as electroplating.

In the electroplating process, electrical current is used to deposit metal ions from a solution onto a wafer, forming a film or patterned structure of metal on the wafer. Certain semiconductor packaging technologies, such as Wafer Level Chip Scale Packaging and Flip Chip, involve multiple electroplating steps. A proper size of a shield between the anode and the wafer is critical to achieve plating uniformity across the wafer surface during the electroplating process.

Conventionally, a wafer carrier 100 used for wafer plating is illustrated in FIG. 1. The wafer carrier cover 100 typically included in a wafer holder for use in a plating bath and fixed size shield 112 mounted onto the wafer holder. The current method of shielding utilizes multiple fixed-size shields 112. Each of the fixed size shields 112 vary in size and dictate a fixed expose area that exposes a portion of a wafer. Since different sizes of the exposed area affect the plating uniformity, the fixed-size shields 112 have to be swapped during electroplating depending on the plating parameters. Swapping of the multiple fixed-size shields is commonly a manual operation, which is tedious and lengthy. Also, creating such fixed-sized shields is very expensive. Further, locating the right fixed-size shield that matches the plating parameters is prone to error in wafer plating process.

SUMMARY

An aspect of the disclosure relates to a wafer carrier comprising an electrically conductive wafer plating jig base having a plurality of concentric overlapping cavities of different depths, each cavity configured to receive a semiconductor wafer of a different size, a plurality of concentric magnetic attractors, at least one positioned within each of the plurality of overlapping cavities, and a cover plate comprising an open center surrounded by a support, the cover plate comprising an attractive material positioned within the support adjacent to the open center and aligned with at least one of the magnetic attractors when the cover plate is positioned over the wafer plating jig base.

Particular embodiments may comprise one or more of the following. A variable aperture shield coupled to the cover, the variable aperture shield may comprise a plurality of fins forming a variable aperture, the plurality of fins mounted on the wafer plating jig base, wherein at least one of the plurality of fins is configured to move towards or away from a center of the variable aperture to change a diameter of the variable aperture. Movement of the shield may comprise a rotation of at least one of the plurality of the fins. Rotation of the fins may comprise a simultaneous rotation of the plurality of fins. At least one of the plurality of the fins may overlap a fin adjacent to the at least one of the plurality of the fins upon the rotation. Movement of the plurality of fins may comprise a convergence of the plurality of fins towards the center of the variable aperture. Each of the plurality of fins may comprise a pivot point configured to move the fin with respect to the wafer plating jig base. Each of the plurality of fins may comprise a lever point configured to move the fin towards or away from the center of the variable aperture. The cover plate may be configured to move the lever points of the fin. The cover plate may be clamped onto the wafer plating jig base to align a center of the cover plate with a center of the wafer plating jig base upon movement of the cover plate. The plurality of fins may be positioned between the wafer plating jig base and the cover plate. The cover plate may comprise a handle configured to move the cover plate.

According to another aspect, a wafer carrier may comprise a variable aperture shield mounted in a semiconductor plating tank. Particular embodiments may comprise one or more of the following. The variable aperture shield may comprise a fixed base plate, and a plurality of fins forming the variable aperture, the plurality of fins mounted on the fixed base plate, wherein at least one of the plurality of fins is configured to move towards or away from a center of the variable aperture to change a diameter of the variable aperture. The movement may comprise a rotation of at least one of the plurality of the fins. The rotation of the fins may comprise a simultaneous rotation of the plurality of fins. At least one of the plurality of the fins may overlap a fin adjacent to the at least one of the plurality of the fins upon the rotation. The movement of the plurality of fins may comprise a convergence of the plurality of fins towards the center of the variable aperture. Each of the plurality of fins may comprise a pivot point configured to move the fin with respect to the fixed base plate. Each of the plurality of fins may comprise a lever point configured to move the fin towards or away from the center of the variable aperture. The variable aperture shield may further comprise a cover plate mounted onto the fixed base plate. The cover plate may be clamped onto the fixed base plate to align a center of the cover plate with a center of the fixed base plate upon movement of the cover plate. The plurality of fins may be positioned between the fixed base plate and the cover plate. The cover plate may be configured to move the lever points of the fin. The cover plate may comprise a handle configured to move the cover plate.

An aspect of the disclosure relates to a method comprising mounting a wafer carrier in a plating bath in a plating tank, the wafer carrier comprising a shield having a variable aperture configured to expose an area of a wafer secured therein, and adjusting the variable aperture of the shield to change a size of the exposed area of the wafer.

Particular embodiments may comprise one or more of the following. The shield may comprise a fixed base plate and a plurality of fins forming the variable aperture mounted onto the fixed base plate, wherein at least one of the plurality of fins is configured to move towards or away from a center of the variable aperture. The shield may comprise a cover plate mounted onto the fixed base plate, wherein the adjusting comprising moving the cover plate to provide movement to the plurality of fins. The moving may comprise rotating the cover plate and the movement comprises rotation of the fins. The movement of the fins may comprise overlapping of the fins. Placing a handle of the cover plate above the plating bath, and wherein the moving the cover plate comprising moving the handle of the cover plate via a drive mechanism.

An aspect of the disclosure comprises a plating tank; and a wafer carrier comprising a variable aperture shield, wherein the wafer carrier is mounted to a side of the plating tank.

Aspects and applications of the disclosure presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. §112, ¶6. Thus, the use of the words "function," "means" or "step" in the Description , Drawings, or Claims is not intended to somehow indicate a desire to invoke the special provisions of 35 U.S.C. §112, ¶6, to define the invention. To the contrary, if the provisions of 35 U.S.C. §112, ¶6 are sought to be invoked to define the claimed disclosure, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. §112, ¶6. Moreover, even if the provisions of 35 U.S.C. §112, ¶6 are invoked to define the claimed disclosure, it is intended that the disclosure not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION and DRAWINGS, and from the CLAIMS.

BRIEF DESCRIPTION OF THE DRAWINGS

The present disclosure is illustrated by way of example, and not by way of limitation, in the figures of the accompanying drawings.

FIG. 10A-10E illustrates five positions of the variable aperture shield to show the change in aperture of the variable aperture shield by actuating the top lever.

DETAILED DESCRIPTION

The following description sets forth numerous specific details such as examples of specific systems, components, methods, and so forth, in order to provide a good understanding of several embodiments of the present disclosure. It will be apparent to one skilled in the art, however, that at least some embodiments of the present disclosure may be practiced without these specific details. In other instances, well-known components or methods are not described in detail or are presented in simple block diagram format in order to avoid unnecessarily obscuring the present disclosure. Thus, the specific details set forth are merely exemplary. Particular implementations may vary from these exemplary details and still be contemplated to be within the scope of the present disclosure and claims.

Embodiments of an apparatus as described for a wafer carrier that provides the ability to perform wafer plating in an automated, low cost and time efficient manner. The wafer carrier allows for a single adjustable mechanism that changes the size of the exposed area of the wafer. In one embodiment, the wafer carrier includes a variable aperture shield. The variable aperture shield provides for a mechanism to change the size of the exposed area of the wafer as desired for wafer plating.

Figure 1:
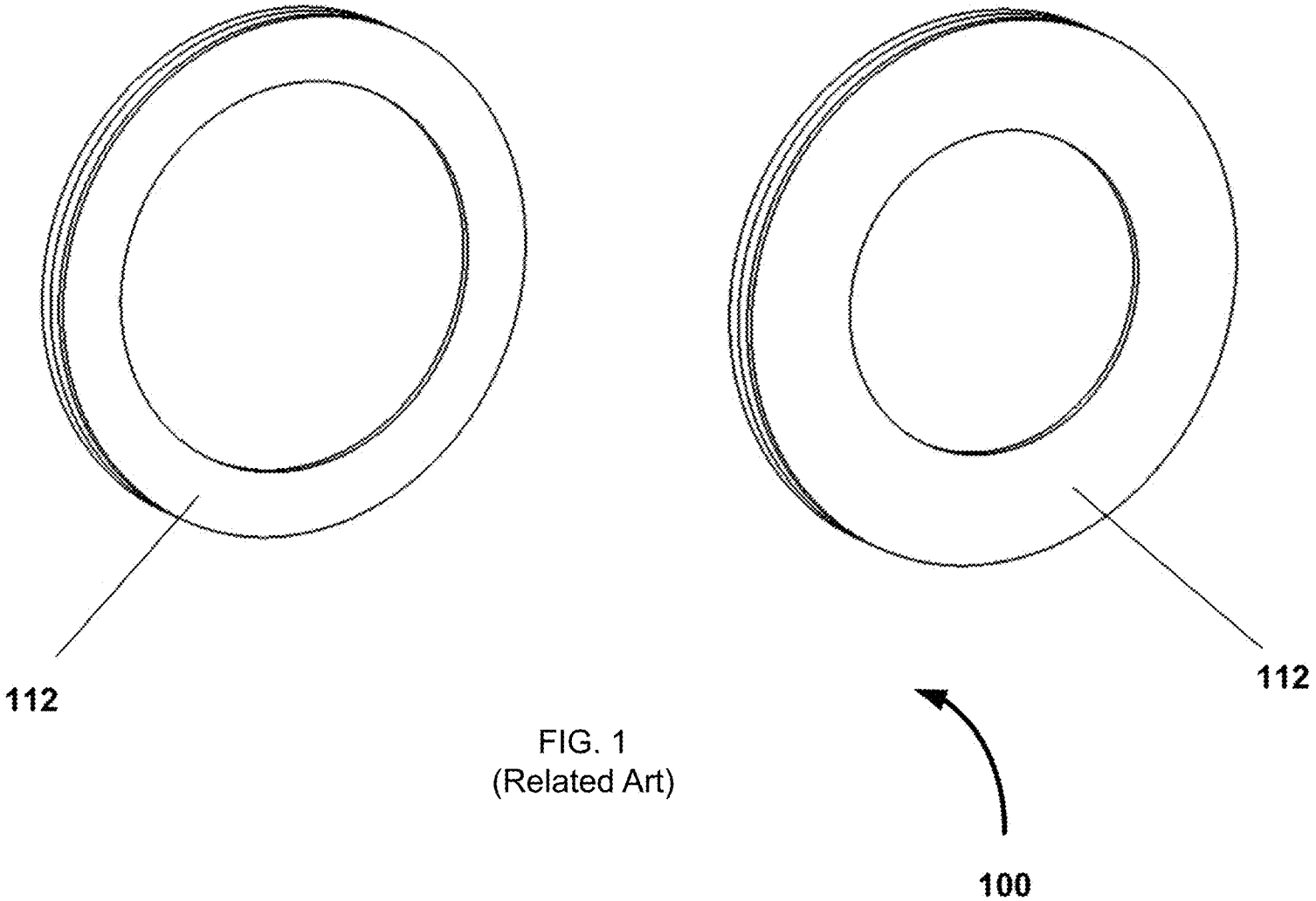
FIG. 1 (Related Art)
FIG. 1 is a diagram illustrating a conventional wafer carrier fixed size shield.
Figures 2A, 2B, 2C:
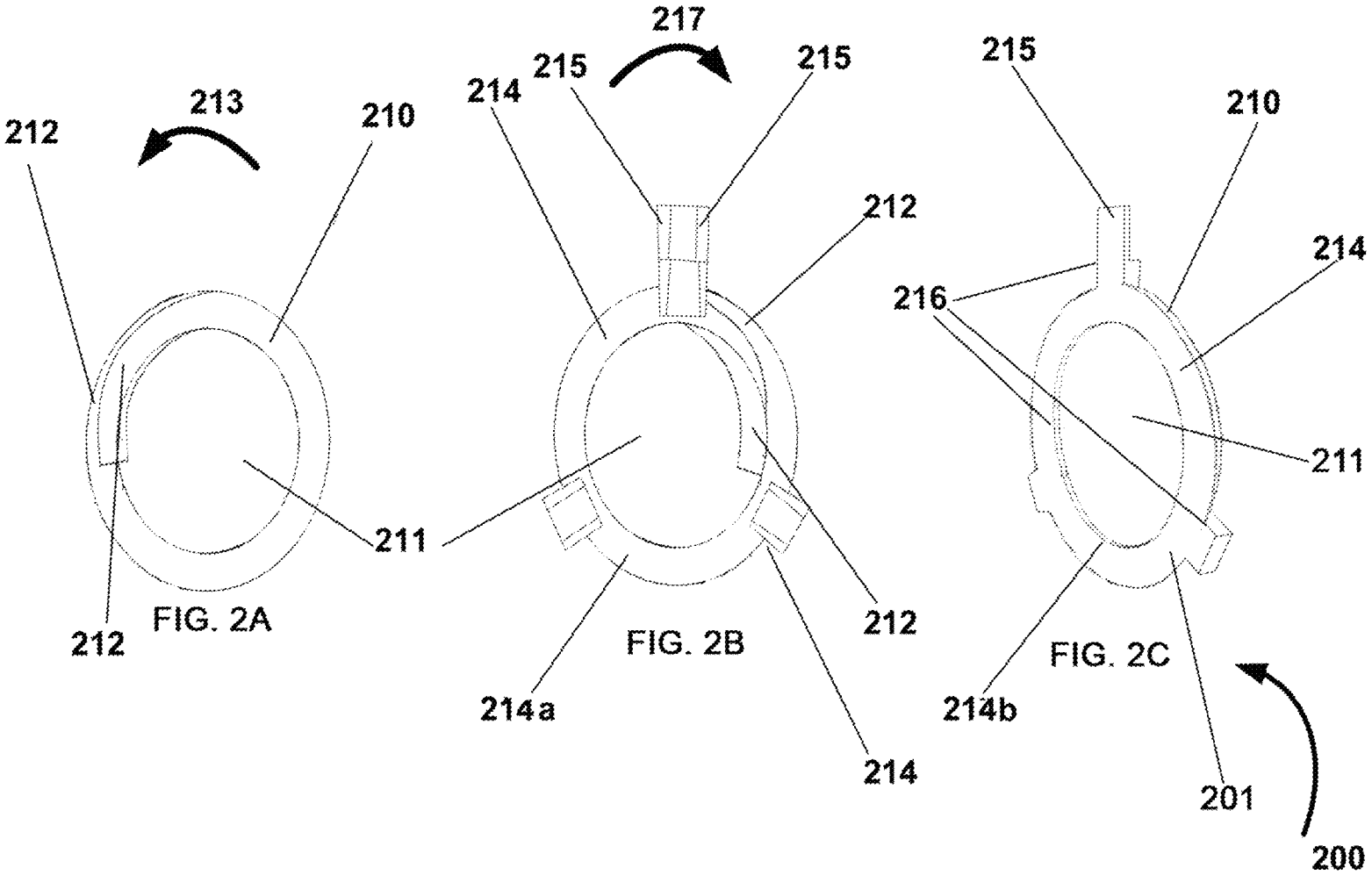
FIG. 2A is a diagram illustrating an embodiment of a wafer carrier shield.
FIG. 2B is a diagram illustrating a variable aperture field of the wafer carrier cover of FIG. 2A.
FIG. 2C is a diagram illustrating a variable aperture field of the wafer carrier cover of FIG. 2A.

FIGS. 2A-2E illustrate a particular embodiment of a wafer carrier 200. The wafer carrier 200 includes a variable aperture shield 201. The variable aperture shield includes a fixed base plate 210. In one embodiment, the fixed base plate 210 is formed of plastic or other non-conductive material, although in other embodiments, the fixed base plate 210 is formed from other materials such as ceramic or metal. The wafer carrier 200 also includes a plurality of fins 212 mounted onto the fixed base plate 210 forming a variable aperture 211 as shown in FIG. 2A. The variable aperture 211 provides for the exposed area for wafer plating. The fin 212 operates to move toward or away from a center of the variable aperture 211. In one embodiment, the fin 212 rotates in a counterclockwise direction 213 towards the center of the variable aperture 211 as illustrated by the line drawing of the fin 212 in FIG. 2A. In one embodiment, the fins 212 rotate simultaneously with respect to one another. In one embodiment, the fins 212 move rotationally, although in other embodiments, the fins 212 may have other types of motions such as linear, periodic, or circular motions. In one embodiment, the fin 212 is formed from plastic material or other non-conductive material, although in other embodiments, the fin 212 is formed from other materials such as ceramic or metal. The variable aperture field 201 further includes a cover plate 214 secured to the fixed base plate 210 covering the fins 212 mounted on the fixed base plate 210. The cover plate 214 includes a rear side 214*a* and a front side 214*b*. In the configuration illustrated in FIG. 2A, the rear side 214*a* is mounted to the fixed base plate 210 such that the fins 212 are placed between the fixed based plate 210 and the rear side 214*a* of the cover plate 214. In an alternate embodiment, the front side 214*b* is mounted to the fixed base plate 210 such that the fins 212 are mounted on the front side 214*b* of the cover plate 214.

In one embodiment, the cover plate 214 is secured to the fixed base plate 210 via clamps 216 as illustrated in FIG. 2, although in other embodiments, the cover plate 214 is pressed or clenched to the fixed base plate 210. The clamps 216 operate as guide rails such that when the cover plate 214 rotates, the center of the cover plate 214 will always align with the center of the fixed base plate 210 as shown in FIG. 2. In one embodiment, the cover plate 214 and the clamps are formed from plastic material or other non-conductive material that is not subject to built upon reduction during processing. Although in other embodiments, the cover plate 214 and the clamps 216 are formed from other materials such as ceramic or metal. As illustrated in FIG. 2C, the cover plate 214 also includes a handle 215 used to rotate the cover plate 214 as will be described in greater detail below.

Figure 2D:
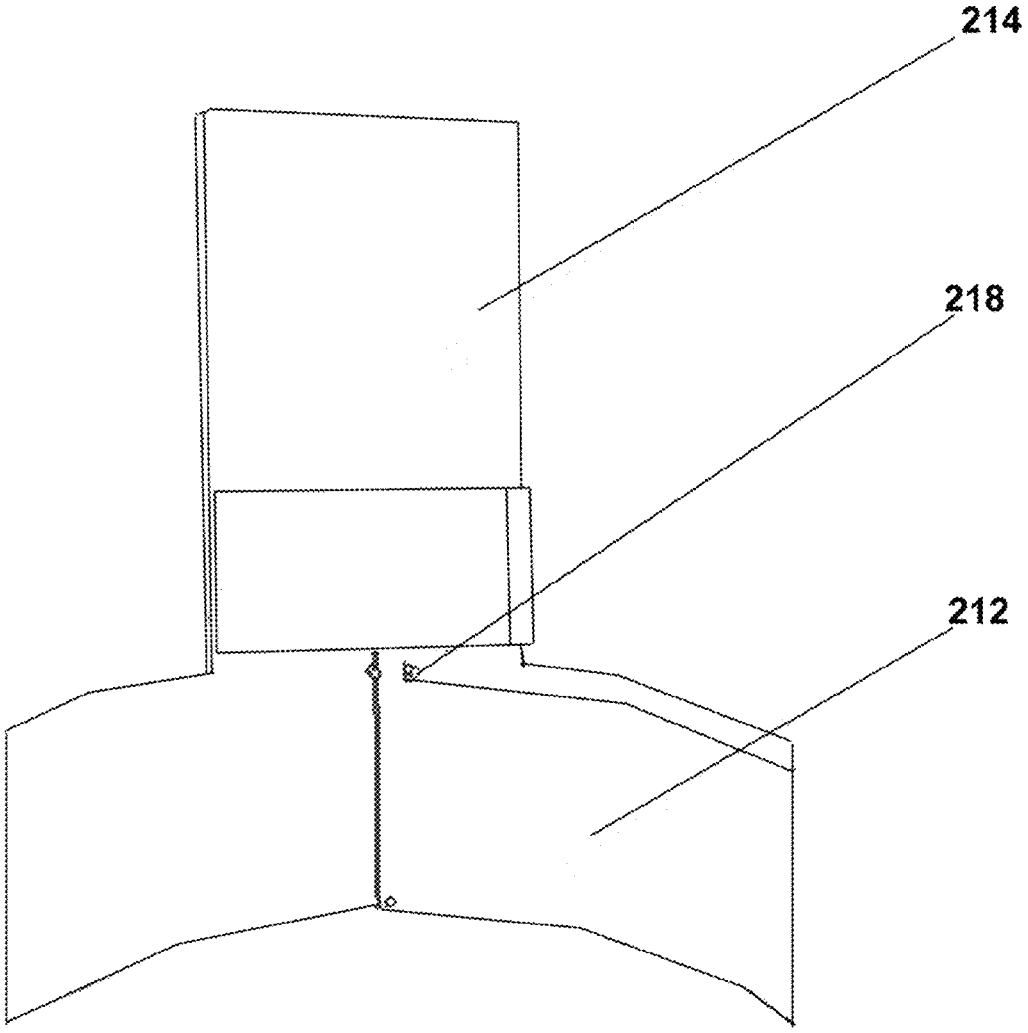
FIG. 2D is a diagram illustrating a close-up view of a portion of the wafer carrier cover of FIG. 2B.

FIG. 2B illustrates a particular embodiment of a rear side of the cover plate 214 of FIG. 2C. The handle 215 is moved away from its original position in FIG. 2C in a clockwise direction 217 as illustrated by the line drawing of the handle 215 in FIG. 2B. This movement of the handle 215 causes the cover plate 214 to also rotate in the clockwise direction 217 as illustrated by the line drawing of the cover plate 214. This rotation of the cover plate 214 in turn pushes the fin 212 to also rotate in the clockwise direction 217 as illustrated by the line drawing of the fin 212 towards the center of the variable aperture 211 as illustrated by the line drawings of the fin 212 in FIG. 2B. Although not shown, the movement of the handle 215 in the opposite direction will cause the cover plate 214 to rotate the fin 212 away from the center of the variable aperture 211. Thus, the cover plate 214 operates to push or pull on the fin 212 toward or away from the center of the variable aperture 211. The embodiment described above provides for a rotational movement, although in other embodiments, other types of movements such as linear, periodic, or circular may be utilized for motion of the handle 215, the cover plate 214 and the fin 212. FIG. 2D shows a close-up rear view of the cover plate 214. In one embodiment, pins 218 are placed on the rear side of the cover plate 214 to rotate the fin 212, although in other embodiments, a bar, notch or gear may be used in place of the pins. When cover plate 214 moves, the pin 218 moves with the cover plate 214 pushing or pulling on the fin 212 resulting in rotation and overlapping of the fins 212.

Figure 2E:
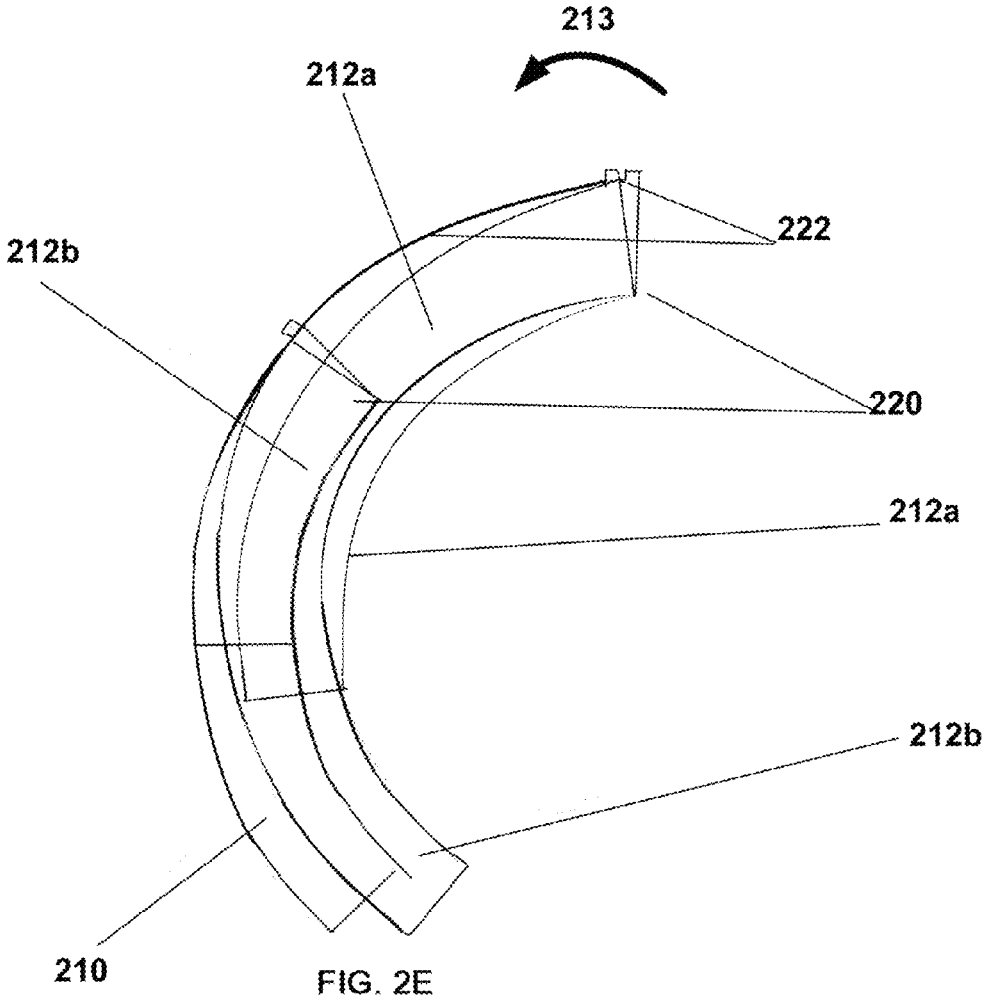
FIG. 2E is a diagram illustrating a close-up view of a fin of the wafer carrier cover of FIG. 2A.

FIG. 2E is a diagram illustrating fin 212*a* and fin 212*b* according to an embodiment of the present disclosure. Each of the fin 212*a* and fin 212*b* are mounted onto the fixed base plate 210 at a pivot point or fulcrum 220. This pivot point or fulcrum 220 allows the fin 212*a* to rotate in a counterclockwise direction 213 with respect to the fixed base plate 210. The fin 212*a* also include a lever point 222 located at one end of the fin 212*a* as shown in FIG. 2B. The rotation of the cover plate 214 pushes the lever points 222 of the fin 212*a* that enables fin 212*a* to rotate at its lever point 222. The rotation of the fin 212*a* causes the fin 212*a* to overlap with an adjacent fin, i.e. fin 212*b*. The fin 212*b* also rotates simultaneously with the fin 212*a* in the counterclockwise direction 213 as illustrated in FIG. 2B. This rotation and overlapping of the fins 212 result in changing diameter of the variable aperture 211 based on the desired sized required of the exposed area for wafer plating as will be described in greater detail below.

Figure 3C:
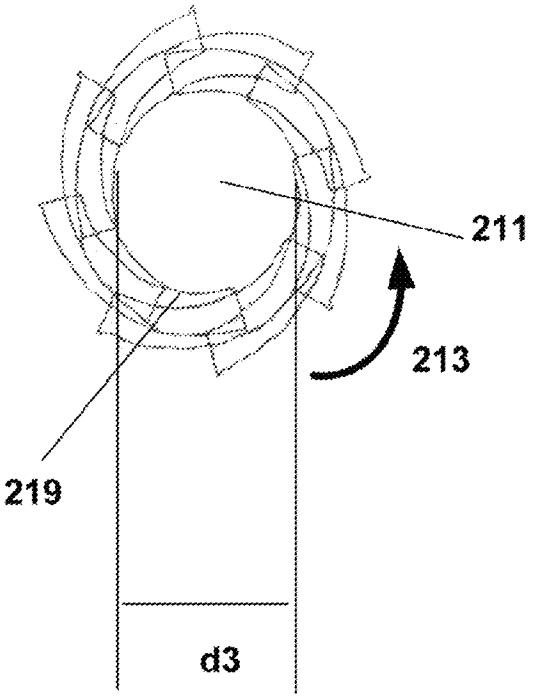
FIGS. 3A-3C are diagrams illustrating positions of fins of an embodiment of a wafer carrier cover.
Figure 3B:
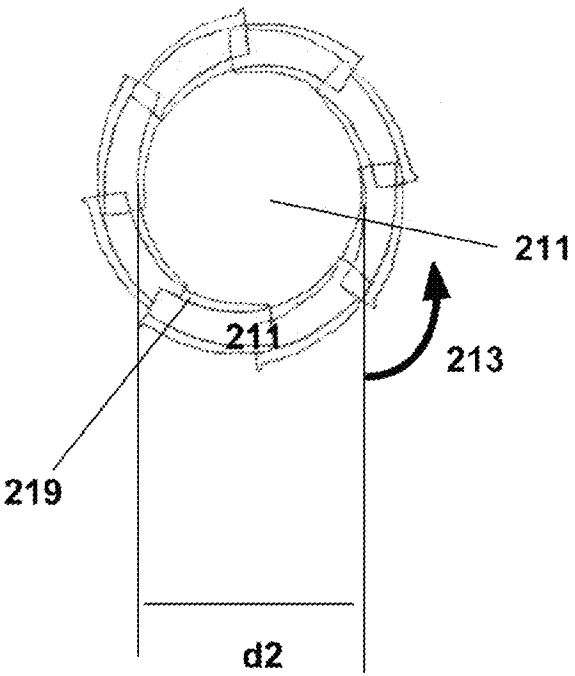
Figure 3A:
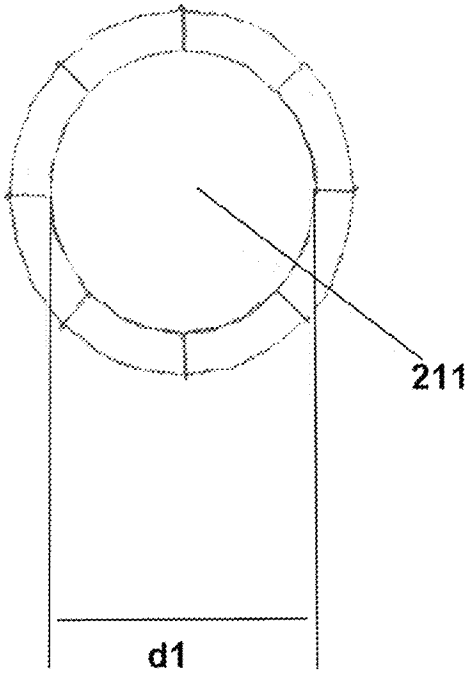

FIGS. 3A-3C illustrates the rotation of the fins 212 of the variable aperture shield 201 of the wafer carrier 200 according to a particular embodiment. As shown in FIG. 3A, fins 212 are positioned at zero degree rotation providing for the variable aperture 211 having a diameter dl large in size desired for placement of a wafer 230. In FIG. 3B, a slight rotation of the cover plate 214 (not shown) in a counterclockwise direction 213 in turn slightly rotates the fins 212 in a counterclockwise direction 213, which causes the fins 212 to overlap one another. This rotation of the fins 212 pushes the fins 212 towards the center of the variable aperture 211 thus reducing the diameter dl of the variable aperture 211 to diameter d2 as shown in FIG. 3B. This reduction in the diameter to d2 provides for a reduced size desired for placement of the wafer 230. In FIG. 3C, the fins 212 are further rotated in the counterclockwise direction 213, which causes further overlapping of the fins 212 and pushing the fins 212 further towards the center of the variable aperture 211. This further rotation of the fins 212 results in further reduction in the size of the diameter d2 of the center of the variable aperture 211 to the diameter d3. This further reduction in diameter d3 provides for a further reduced size desired for plating the wafer 230. The rotation and the overlapping of the fins 212 cause the convergence of the fins 212 toward the center of the variable aperture 211. In one embodiment, the overlapping of the fins 212 causes the fins 212 to converge to form a circular shield 219 having a diameter although in other embodiments, the shield may have other shapes and sizes tailored to the particular semiconductor wafer being plated. It should not be assumed that the shape of the wafer will always be circular, though that is currently true in a majority of the cases. The values of the d1, d2 and d3 vary based on the size of the wafer 230, the shape of the fin 212 and number of fins 212. In one non-limiting example, the wafer 230 having an approximate size of 300 mm and depending on the shape and number of the fins, the value of diameter dl may range between 260 mm to 300 mm, the value of diameter d2 may range between 230 mm to 260 mm, and the value of diameter d3 may range between 200 mm to 230 mm. In another example, a wafer having an approximate size of 200 mm wafer and depending on the shape and number of the fins, the value of diameter dl may range between 160 nm to 200 mm, the value of diameter d2 may range between 130 mm to 160 mm, and the value of diameter d3 may range between 100 mm to 130 mm.

Figure 4:
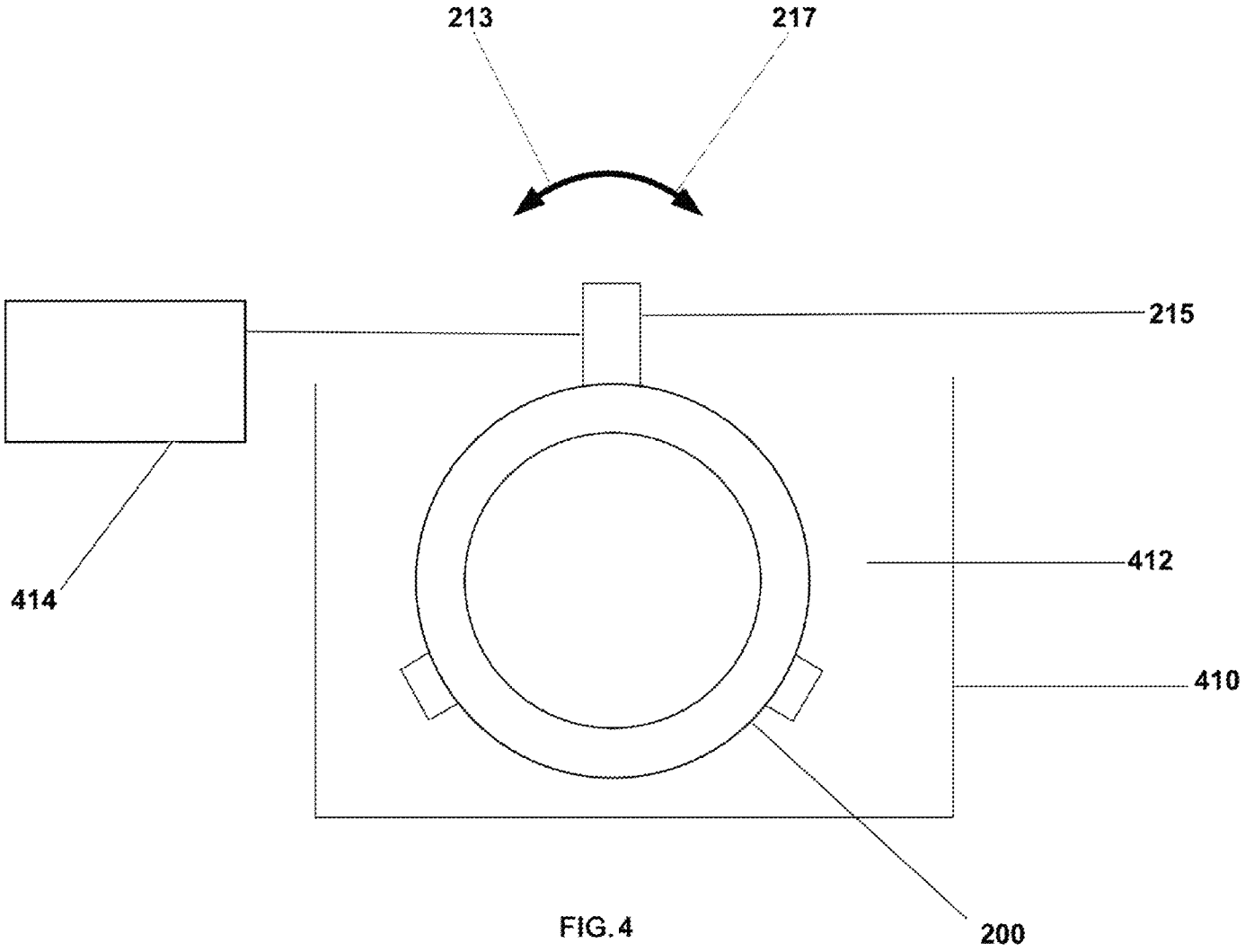
FIG. 4 is a diagram illustrating a system for wafer plating.

FIG. 4 illustrates a particular embodiment of a plating system 400. The system includes a plating bath 410 having a plating solution 412. The wafer carrier 200 is placed in the plating bath 410 for wafer plating. The fixed base plate 210 of the wafer carrier 200 is affixed to the plating bath 410 prevent any movement of the fixed base plate 210. The wafer carrier 200 is placed in the plating bath 410 such that the handle 215 of the cover plate 214 will be positioned above the plating bath 410 as shown in FIG. 4. The plating system 400 also includes a drive mechanism 414 coupled to the handle 215 of the wafer carrier 200. In one embodiment, the drive mechanism 414 is an operator manually moving the handle 215. In another embodiment, the drive mechanism 414 is a machine that operates to provide for automated movement of the handle 215. As illustrated in FIG. 4, the handle 215 is rotated in either the clockwise direction 217 or the counterclockwise direction 213. The diameter of the variable aperture 211 is based on a rotation of the cover plate 214, which in turn will have a corresponding handle position. So, the handle 215 is moved to a specific distance based upon the diameter size desired for the variable aperture 211 for placement of the wafer.

Figure 5:
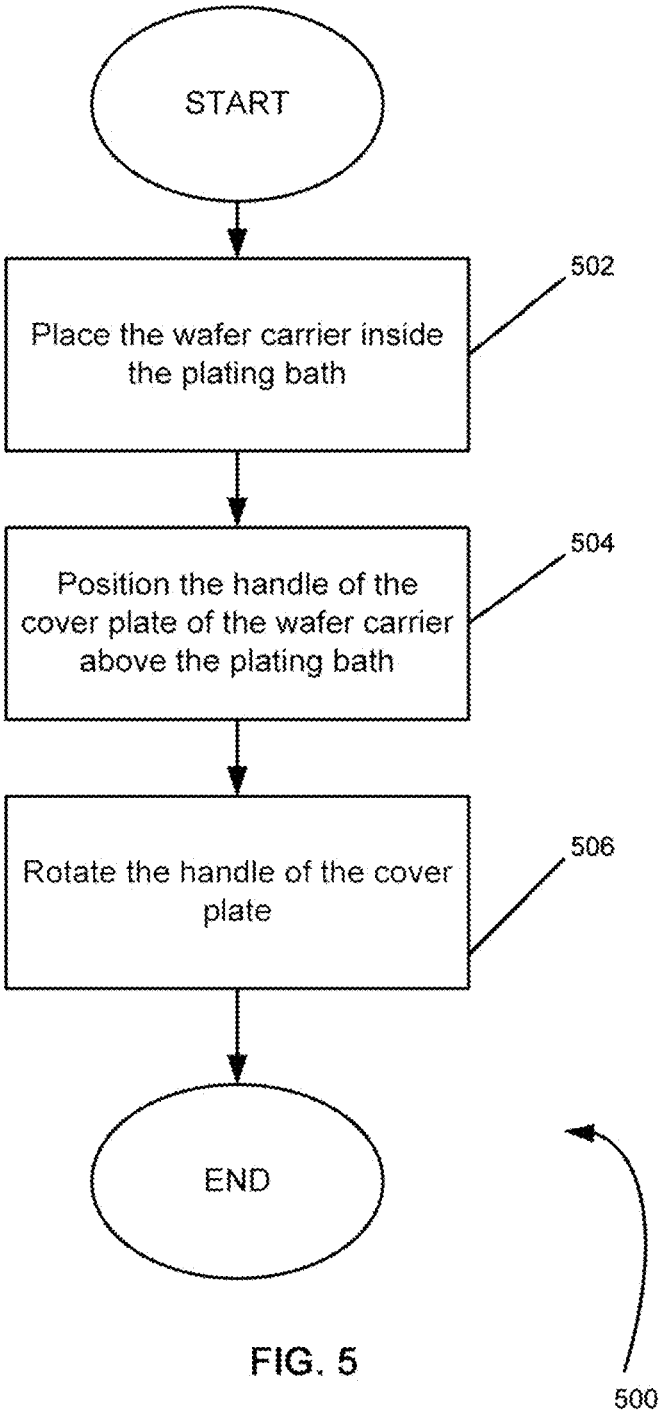
FIG. 5 is a flow chart illustrating a method for wafer plating.

FIG. 5 is a flow diagram of one embodiment of a method for wafer plating. Hardware, software or combination of these components may be used to perform method 500. The method 500 starts from block 502 at which a wafer carrier 200 is placed inside the plating bath 410. At block 504, the handle 215 of the cover plate 214 of the wafer carrier is positioned above the plating bath 410. At block 506, the handle 215 is rotated via the drive mechanism 414. This rotation of the handle 215 in turn rotates the cover plate 214, which causes rotations of the fins 212.

Figure 6B:
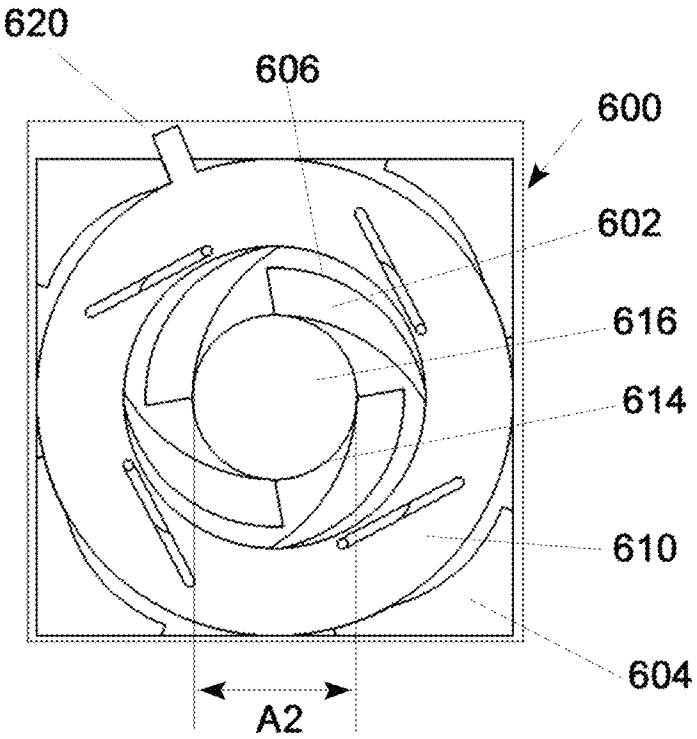
FIGS. 6A and 6B are diagrams of a wafer carrier having a variable aperture shield at, respectively, a first open position and a second smaller open position.
Figure 6A:
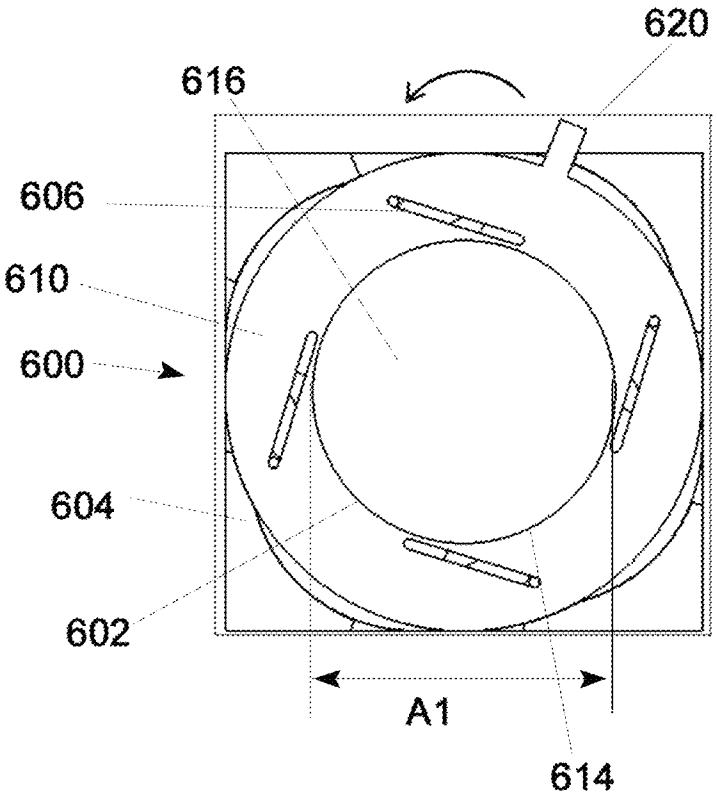

FIGS. 6A and 6B are diagrams illustrating a wafer carrier 600 having a variable aperture shield 602 that includes a fixed base 604 with multiple overlapping fins 606. In this particular embodiment, multiple overlapping fins 606 are mounted on a fixed base plate 610. In use, this wafer carrier, holding a semiconductor wafer, may have its exposed area 614 adjusted between a wide opening A1 in FIG. 6A and a smaller opening A2 in FIG. 6B by adjustment of the handle 620. In particular embodiments, the variable aperture shield 602 will adjust and operate similar to the variable aperture shields described above. The variable aperture shield 602 can be used to change the size of an exposed area 614 of a semiconductor wafer 616. In particular use, when a semiconductor wafer of a particular size is placed within the wafer carrier 600, the handle 620 may be adjusted to adapt the exposed area 614 to the particular size of the semiconductor wafer 616 placed in the wafer carrier 600. This allows the same shield to be used with a plurality of different wafer carriers and wafers. In particular, in FIG. 6A, the exposed area 614 (with diameter A1) is when the fins 606 are at a zero degree rotation, creating a large exposed area. In FIG. 6B, the exposed area 614 (with diameter A2) is when the fins are rotated further, resulting in the exposed area 614 being smaller in FIG. 6B than the exposed area 614 in FIG. 6A. The fins 606 can be configured to rotate simultaneously towards or away from the center to change the size of the exposed area 614.

Figure 11B:
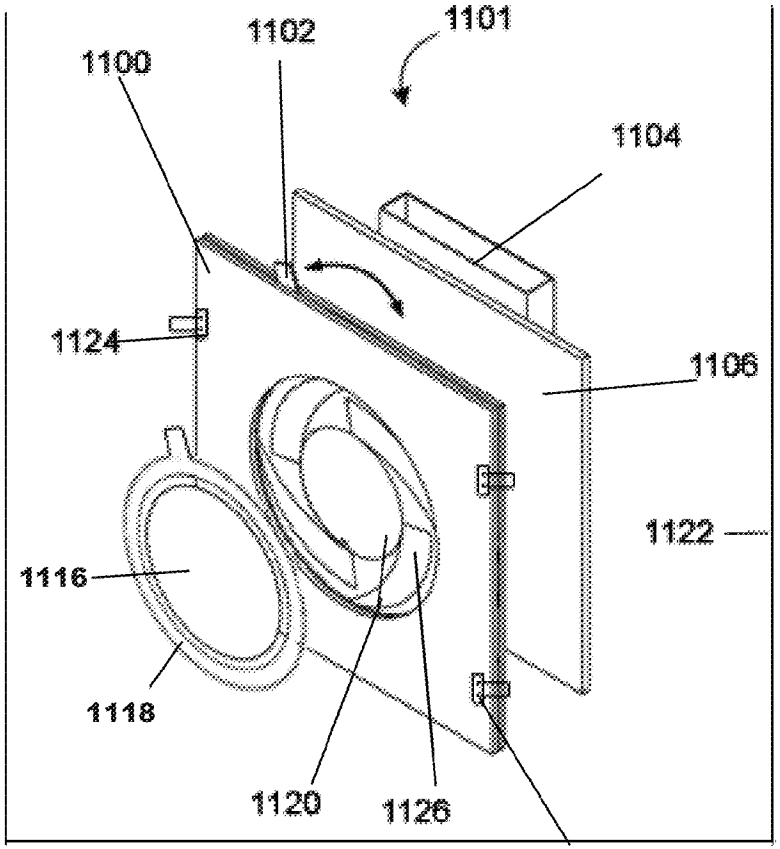
FIGS. 11A and 11B illustrate two exposed area opening sizes for a variable aperture shield placed in a plating tank.
Figure 11A:
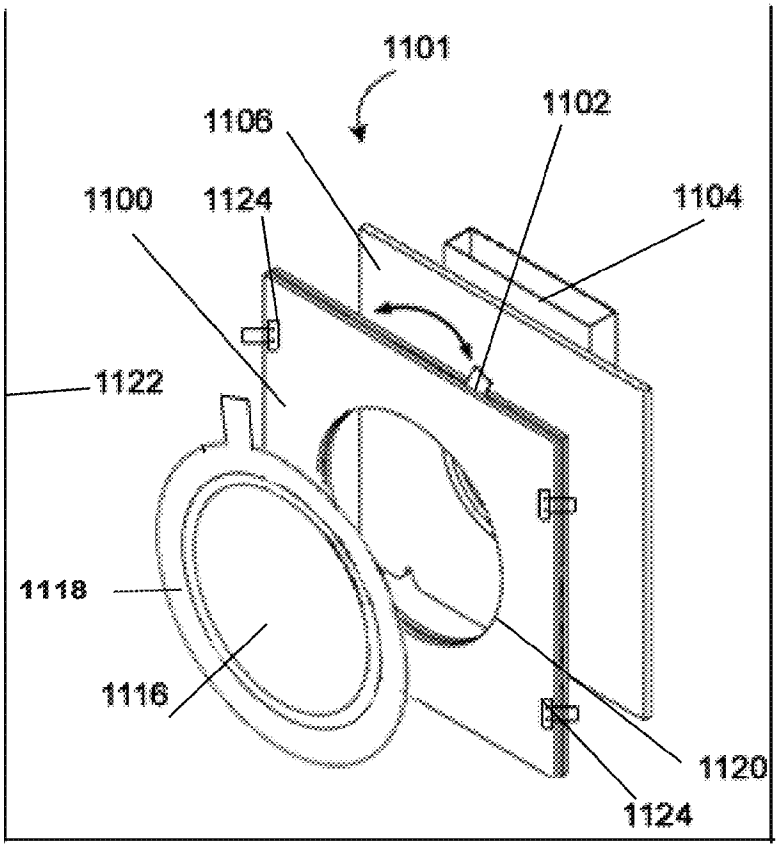

The following embodiments are directed to a variable-aperture shield separate from the wafer carrier that can be mounted in a plating tank adjacent to where a wafer carrier will be placed. FIGS. 11A and 11B illustrate an overall perspective view of a wafer plating system according to a particular embodiment. As described further herein, an annular-shaped shield covers the outer region of the wafer to achieve better plating uniformity across the entire wafer surface including near the edges of the semiconductor wafer. The embodiments described herein are directed to a variable aperture shield mechanism that changes the size of the exposed area of the semiconductor wafer. These embodiments may provide benefits or advantages over conventional solutions in that the embodiments provide a single mechanism to replace multiple fixed-size shields as with the previous embodiments described herein. Additionally, and distinct from conventional shields which are formed as part of the wafer carrier, particular embodiments described hereafter are specifically designed for mounting within the plating tank separate from the wafer carrier so that more generic wafer carriers can be used and shielding can be adjusted and determined through the separate adjustable shield mounted more permanently within the plating tank. In this way, particular embodiments disclosed may adjust the exposed area without swapping in and out the multiple fixed-size shields. In some embodiments, automatic adjustment is possible when integrated into a plating machine and the variable aperture shield's setting can be configured as a product or process recipe parameter to integrate automatic adjustment into the process flow.

Figure 7B:
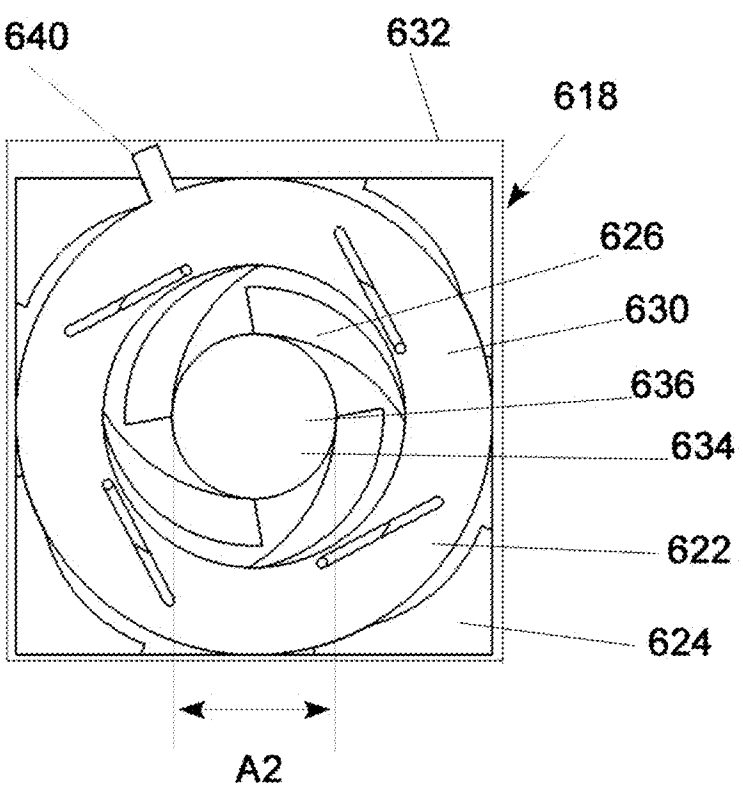
FIGS. 7A and 7B are diagrams illustrating a variable aperture shield mounted on a plating tank, the variable aperture shield at, respectively, a first open position and a second smaller open position.
Figure 7A:
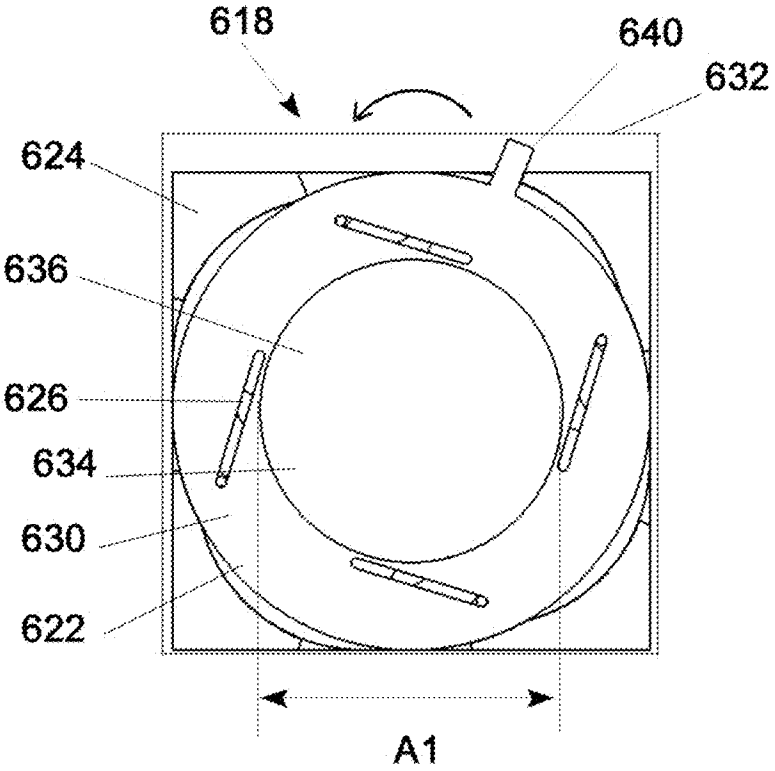

FIGS. 7A and 7B are diagrams illustrating a wafer carrier 618 having a variable aperture shield 622 that includes a fixed base 624 with multiple overlapping fins 626. In this particular embodiment, multiple overlapping fins 626 are mounted on a fixed base plate 630. In use, this wafer carrier, holding a semiconductor wafer, may have its exposed area 634 adjusted between a wide opening A1 in FIG. 7A and a smaller opening A2 in FIG. 7B by adjustment of the handle 640. In particular embodiments, the variable aperture shield 622 will adjust and operate similar to the variable aperture shields described above. The variable aperture shield 622 can be used to change the size of an exposed area 634 of a semiconductor wafer 636. In particular use, when a semincoductor wafer of a particular size is placed within the wafer carrier 618, the handle 640 may be adjusted to adapt the exposed area 634 to the particular size of the semiconductor wafer 636 placed in the wafer carrier 618. This allows the same shield to be used with a plurality of different wafer carriers and wafers. In particular, in FIG. 7A, the exposed area 634 (with diameter A1) is when the fins 626 are at a zero degree rotation, creating a large exposed area. In FIG. 7B, the exposed area 634 (with diameter A2) is when the fins are rotated further, resulting in the exposed area 634 being smaller in FIG. 7B than the exposed area 634 in FIG. 7A. The fins 626 can be configured to rotate simultaneously towards or away from the center to change the size of the exposed area 634. The handle 640 may be moved between positions using a pneumatic actuator.

In a particular embodiment with a pneumatic actuator or pneumatic cylinder, the variable shield aperture shield 622 may be made up of CPVC material. The actuation may be performed using a pneumatically actuated cylinder attached to a top handle 640. The top lever 640 is above a plating solution in the plating tank so that the actuation is done above the plating solution. The position of the top lever 640 determines the size of the cathode shield of the variable shield aperture. FIG. 7A illustrates the top handle 640 in a first position and FIG. 7B illustrates the top handle 640 in a second position. It should be noted that, by increasing the number of fins of the variable aperture shield 622, the inside diameter of the shield 634 could be continuously adjustable between an upper and lower limit. Additional fins may help to approximate a circular shape at intermediate values of inside diameters.

Figure 8:
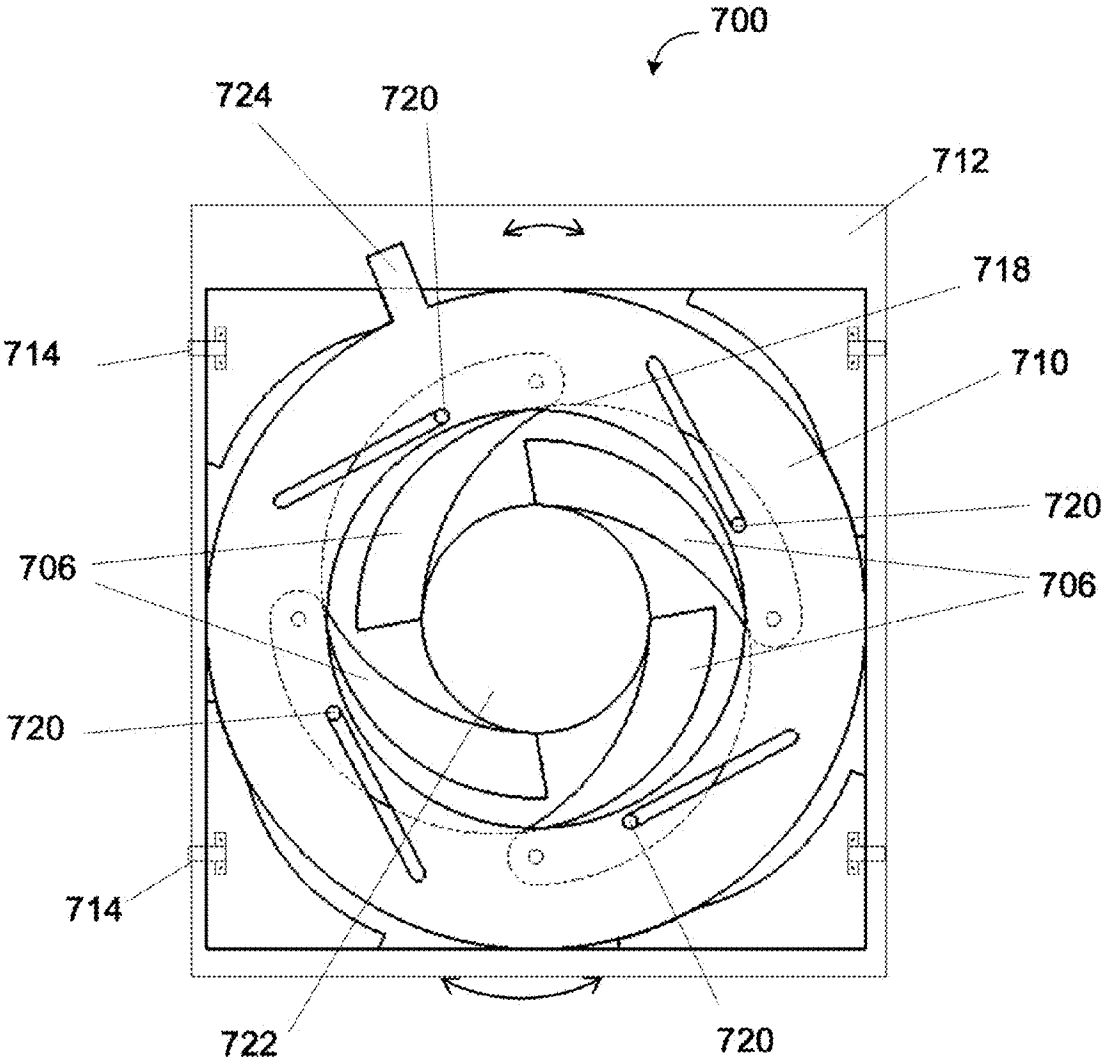
FIG. 8 is a diagram illustrating a wafer carrier having a variable aperture shield mounted on a plating tank, the variable aperture shield including a fixed base with multiple overlapping fins.

FIG. 8 is a diagram illustrating a wafer carrier 700 having a variable aperture shield 702 mounted on a plating tank 712, the variable aperture shield 702 including a fixed base 710 with multiple overlapping fins 706, according to another embodiment. The variable aperture shield 702 is similar to the variable aperture shield 602 and 622, but includes a pivot point (also referred to a fulcrum) 720 for each fin 706. The convergence of the fins 706 forms the exposed area of the shield 702. Each fin 706 has a pivot point 720 that allows the fin 706 to rotate. In particular, each fin 706 is moved at is lever point 718 to rotate towards or away from the center of the variable aperture shield 702.

Figure 9:
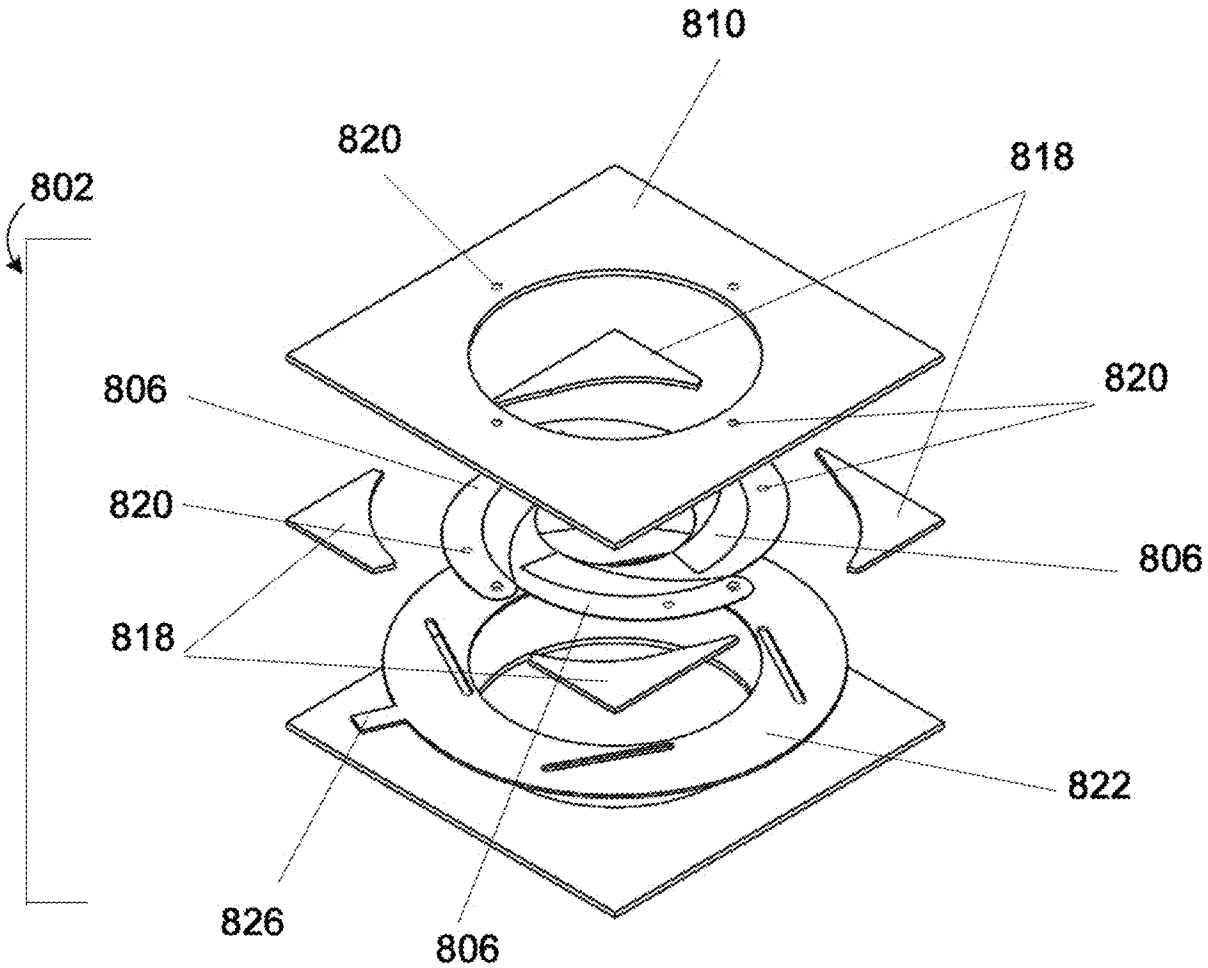
FIG. 9 is a diagram illustrating a stack-up of a variable aperture shield to be mounted on a plating tank.

FIG. 9 is an exploded view diagram illustrating a stack-up of a variable aperture shield 802 to be mounted on a plating tank according to another embodiment. In this embodiment, the fins 806 are mounted on a fixed base plate 810 at their respective pivot points or fulcrums 820. A cover plate 822 moves the pivot points 820 of the fins 806 so that when the cover plate 822 rotates (by manually or automatically moving a handle of the cover plate 822), the fins 806 simultaneously rotate with the cover plate 822. The cover plate 822 is clamped to the base plate 810 so that when the cover plate 822 rotates, the cover plate 822 aligns with the center of the base plate 810. In a further embodiment, spacers 818 may be disposed between the base plate 810 and the cover plate 822 to maintain the cover plate 822 in a designated position. The variable aperture shield 802 can be mounted to a plating tank as described in more detail below with respect to FIGS. 11A and 11B.

FIG. 10A-10E illustrates five positions of a variable aperture shield 1000 to show the change in aperture of the variable aperture shield 1000 by actuating the top lever 1002 according to one embodiment. FIG. 10A illustrates the top lever 1002 in a first position 1004. FIG. 10B illustrates the top lever 1002 in a second position 1006. FIG. 10C illustrates the top lever 1002 in a third position 1008. FIG. 10D illustrates the top lever 1002 in a fourth position 1010. FIG. 10E illustrates the top lever 1002 in a fourth position 1012.

FIGS. 11A and 11B illustrate a variable aperture shield 1101 placed in a plating tank 1122 according to one embodiment. In this embodiment, the variable aperture shield 1100 is placed in a plating bath comprising plating solution by mounting the variable aperture shield 1100 to structure on or within the plating tank through brackets 1124. In one embodiment, the variable aperture shield's 1100 base plate is mounted to the plating tank so that the variable aperture shield 1100 does not move during the plating process. In operation, a wafer 1116 is held by a wafer plating jig 1118, such as that shown and described in co-pending U.S. patent application Ser. 13/631,204 titled "Magnetically Sealed Wafer Plating Jig System and Method," filed Sep. 28, 2012, the disclosure of which is incorporated in its entirety herein by this reference. An anode 1104 is placed within the tank on a side of the variable aperture shield 1100 opposite the wafer 1116. The semiconductor wafer 1116 is held in the wafer plating jig 1118 in front of the plating anode 1104 with one or more plating shields 1100 (variable aperture), 1106 (fixed aperture) between the anode 1104 and the semiconductor wafer 1116. The handle 1102 of the variable aperture shield 1100 is above the plating solution (not shown). To rotate the fins 1126 to cover a portion of the aperture 120 through the variable aperture shield 1100, the operator or a machine moves the handle 1102. The wafer plating jig 1118 is coupled electrically to a control system (not shown) providing the appropriate negative charge to the wafer plating jig 1118 for the plating process through a connector. For this embodiment, the semiconductor wafer 1116 is exposed to an electric current through the plating solution from the anode 1104 through both the variable aperture plating shield 1100 and a fixed aperture plating shield 1106. The plating process generally is known to those of ordinary skill in the art.

During a lot start of the plating process, the desired size of the exposed area is defined as a parameter of the product and process. The desired size corresponds to a rotation of the cover plate, which in turn corresponds to a handle position. When integrated to the machine, the variable aperture shield 1100 makes it possible to automate the process of changing the shield size as triggered by the machine recipe. This will significantly reduce potential plating errors due to wrong shield size.

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner.

The particular features, structures or characteristics described herein may be combined as suitable in one or more embodiments. In addition, while the disclosure has been described in terms of several embodiments, those skilled in the art will recognize that the disclosure is not limited to the embodiments described. The embodiments can be practiced with modification and alteration within the scope of the appended claims. The specification and the drawings are thus to be regarded as illustrative instead of limiting on the disclosure or any particular embodiment.

What is claimed is:

1. An apparatus comprising:

a plating tank;

a wafer plating jig configured to hold a semiconductor wafer and to be disposed at least partially within the plating tank and;

a variable aperture shield, wherein the wafer carrier is mounted to a side of the plating tank and configured to be disposed adjacent the wafer plating jig, wherein the variable aperture shield further comprises:

a cover plate, a plurality of fins coupled to the cover plate wherein the plurality of fins form a variable aperture and at least one of the plurality of fins coupled to the cover plate is configured to move towards or away from a center of the variable aperture to change a diameter of the variable aperture, and a handle coupled to the cover plate.

2. The apparatus of claim 1, wherein the variable aperture shield is disposed at least partially within the plating tank and the handle is configured to be disposed above a plating solution.

3. The apparatus of claim 1, wherein a size of an aperture of the variable aperture shield is adjustable while the variable aperture shield is disposed at least partially within the plating tank.

4. The apparatus of claim 1, wherein the movement comprises a rotation of at least one of the plurality of the fins.

5. The apparatus of claim 4, wherein the rotation of the at least one of the plurality of fins comprises a simultaneous rotation of the plurality of fins and of the handle.

6. The apparatus of claim 4, wherein at least one of the plurality of the fins overlaps a fin adjacent to the at least one of the plurality of the fins upon the rotation.

7. The apparatus of claim 1, wherein the movement of the plurality of fins comprises a convergence of the plurality of fins towards the center of the variable aperture.

8. The apparatus of claim 1, wherein each of the plurality of fins comprises a pivot point configured to move the fin with respect to the cover plate.

9. The apparatus of claim 1, wherein each of the plurality of fins comprises a lever point configured to move the fin towards or away from the center of the variable aperture.

10. The apparatus of claim 9, wherein the handle of the cover plate is configured to move the lever points of the plurality of fins.

11. The apparatus of claim 1, wherein the variable aperture shield is separate from the wafer plating jig.

12. The apparatus of claim 1, wherein the wafer plating jig comprises a plurality of concentric overlapping cavities of different depths, each cavity configured to receive a semiconductor wafer of a different size.

13. An apparatus comprising:

a plating tank; and a variable aperture shield mounted to the plating tank and configured to be disposed adjacent a semiconductor wafer to be plated, wherein the variable aperture shield further comprises:

a cover plate, a plurality of fins coupled to the cover plate wherein the plurality of fins form a variable aperture and at least one of the plurality of fins coupled to the cover plate is configured to move towards or away from a center of the variable aperture to change a diameter of the variable aperture, and a handle coupled to the cover plate.

14. The apparatus of claim 13, wherein the variable aperture shield is disposed at least partially within the plating tank and the handle is configured to be disposed above a plating solution.

15. The apparatus of claim 13, wherein a size of an aperture of the variable aperture shield is adjustable while the variable aperture shield is disposed at least partially within the plating tank.

16. The apparatus of claim 13, wherein the movement of the plurality of fins comprises a convergence of the plurality of fins towards the center of the variable aperture.

17. The apparatus of claim 13, wherein each of the plurality of fins comprises a pivot point configured to move the fin with respect to the cover plate.

18. The apparatus of claim 13, wherein each of the plurality of fins comprises a lever point configured to move the fin towards or away from the center of the variable aperture.

19. The apparatus of claim 18, wherein the handle of the cover plate is configured to move the lever points of the plurality of fins.

20. The apparatus of claim 13, further comprising a wafer plating jig separate from the variable aperture shield, the wafer plating jig configured to hold the semiconductor wafer and to be disposed at least partially within the plating tank adjacent the variable aperture shield.

21. An apparatus comprising:

a plating tank; and a variable aperture shield mounted to the plating tank and configured to be disposed adjacent a semiconductor wafer to be plated wherein a size of an aperture of the variable aperture shield is adjustable while the variable aperture shield is disposed at least partially within the plating tank wherein the variable aperture shield comprises a plurality of fins that form a variable aperture and at least one of the plurality of fins coupled to a cover plate is configured to rotatably move towards or away from a center of the variable aperture to change a diameter of the variable aperture.

22. The apparatus of claim 21, further comprising a handle formed as part of the variable aperture shield, wherein the variable aperture shield is disposed at least partially within the plating tank.

23. The apparatus of claim 22, wherein the handle is configured to be disposed above a plating solution contained within the plating tank.

24. The apparatus of claim 21, wherein the movement of the plurality of fins comprises a convergence of the plurality of fins towards the center of the variable aperture.

25. The apparatus of claim 21, wherein each of the plurality of fins comprises a pivot point configured to move the fin with respect to the cover plate.

26. The apparatus of claim 21, wherein each of the plurality of fins comprises a lever point configured to move the fin towards or away from the center of the variable aperture.

27. The apparatus of claim 26, wherein the variable aperture shield comprises a cover plate comprising a handle that is configured to move the lever points of the plurality of fins.

28. The apparatus of claim 21, further comprising a wafer plating jig separate from the variable aperture shield, the wafer plating jig configured to hold the semiconductor wafer and to be disposed at least partially within the plating tank adjacent the variable aperture shield.

* * * * *